US006408634B1

(12) United States Patent
Choi

(10) Patent No.: US 6,408,634 B1
(45) Date of Patent: Jun. 25, 2002

(54) MULTI-CHAMBER REFRIGERATION SYSTEM UTILIZING A SINGLE COMPRESSOR AND DIGITAL TEMPERATURE CONTROLS

(75) Inventor: Tai Choi, Lafayette, CA (US)

(73) Assignee: Jimex Corporation, Alameda Point, CA (US)

( * ) Notice: Subject to any disclaimer, the term of this patent is extended or adjusted under 35 U.S.C. 154(b) by 0 days.

(21) Appl. No.: 09/641,558

(22) Filed: Aug. 17, 2000

(51) Int. Cl.[7] ..... F25D 21/06

(52) U.S. Cl. ..... 62/127; 62/162; 62/151; 62/200

(58) Field of Search ..... 62/125, 126, 127, 62/129, 130, 199, 200, 161, 162, 163, 164, 151, 152, 155, 156; 236/94

(56) References Cited

U.S. PATENT DOCUMENTS 4,439,998 A * 4/1984 Horvay et al. ..... 62/200 X
4,646,528 A * 3/1987 Marcade et al. ..... 62/127
4,685,615 A * 8/1987 Hart ..... 236/94
5,136,865 A * 8/1992 Aoki et al. ..... 62/126
5,465,591 A * 11/1995 Cur et al. ..... 62/199 X
5,482,209 A * 1/1996 Cochran et al. ..... 236/94 X

* cited by examiner

*Primary Examiner*—Harry B. Tanner
(74) *Attorney, Agent, or Firm*—Dergosits & Noah LLP

(57) ABSTRACT

A multi-chamber refrigeration system is described. The refrigeration system comprises a first refrigeration compartment within a housing, and a second refrigeration compartment within the housing and mechanically coupled to the first refrigeration compartment. A control unit is electrically coupled to the first refrigeration unit and the second refrigeration compartment. A compressor is coupled to the control unit through a first solenoid valve and through a second solenoid valve. The first solenoid valve is operable to alter an operating temperature of the first refrigeration compartment, and the second solenoid valve operable to alter an operating temperature of the second refrigeration compartment.

17 Claims, 8 Drawing Sheets

MULTI-CHAMBER REFRIGERATION SYSTEM UTILIZING A SINGLE COMPRESSOR AND DIGITAL TEMPERATURE CONTROLS

FIELD OF THE INVENTION

The present invention relates generally to refrigeration systems, and more specifically to a multi-chamber refrigeration system that utilizes a single compressor.

BACKGROUND OF THE INVENTION

Present industrial refrigerators are often large units that include separate chambers for freezer and refrigeration functions. Though recent designs may feature improvements in performance and functional characteristics, improvements are possible with regard to efficiency and usability features. For example, present systems often include temperature control settings that are cumbersome and not easy to access and use. Nor do these systems provide adequate displays of the operating conditions of the refrigerator. For many systems the relevant controls and displays are located inside one of the refrigerator compartments. Thus, the unit must be opened in order to change or even view the operating settings.

Another disadvantage of present refrigeration systems is that routine operating or maintenance operations must be often performed manually. For example, freezer units are generally susceptible to the accumulation of ice on the evaporator coils and must be defrosted periodically to increase coil life and maintain efficiency. Many units include a built-in defrost feature that prevents the build up of frost by periodically altering the temperature within the freezer unit to eliminate frost accumulation on the evaporator coils and/or on the inside walls of the freezer. However, this feature must often be activated manually through the use of dial controls within the freezer unit. Even for units that include an automated defrost feature, which does not require manual activation, the defrost times are generally programmed into the control unit, and are not configurable by the user. Thus these settings cannot be easily configured to provide optimum use in accordance with the particular operating conditions of the refrigeration unit.

Although many present industrial refrigeration systems feature an integrated design in which a refrigerator unit and a freezer chamber are packaged together within a single housing, the functionality of each chamber is often set by the manufacturer. For these systems, the user cannot easily change the function of a particular chamber from freezer to refrigerator or vice-versa. Such units generally also utilize different refrigeration and control circuitry for each chamber. For example, a typical dual-chamber refrigeration unit often incorporates a dedicated compressor and control unit for each freezer and refrigeration chamber. This results in a duplication of circuitry and increased manufacturing costs.

SUMMARY OF THE INVENTION

A multi-chamber refrigeration system is described. The refrigeration system comprises a first refrigeration compartment within a housing, and a second refrigeration compartment within the housing and mechanically coupled to the first refrigeration compartment. A control unit is electrically coupled to the first refrigeration unit and the second refrigeration compartment. A compressor is coupled to the control unit through a first solenoid valve and through a second solenoid valve. The first solenoid valve is operable to alter an operating temperature of the first refrigeration compartment, and the second solenoid valve is operable to alter an operating temperature of the second refrigeration compartment. The control unit is accessible through a hinged panel in a control compartment located above one of the refrigerator compartments. The temperature settings for the refrigeration system can be viewed through a transparent window in the hinged panel when the panel is in closed position.

Other objects, features, and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements, and in which.

DETAILED DESCRIPTION OF THE INVENTION

A multi-chamber refrigerator utilizing a single compressor and digital temperature controls is described. In the following description, for purposes of explanation, numerous specific details are set forth in order to provide a thorough understanding of the present invention. It will be evident, however, to one of ordinary skill in the art, that the present invention may be practiced without these specific details. In other instances, well-known structures and devices are shown in block diagram form to facilitate explanation. The description of preferred embodiments is not intended to limit the scope of the claims appended hereto.

Figure 1:
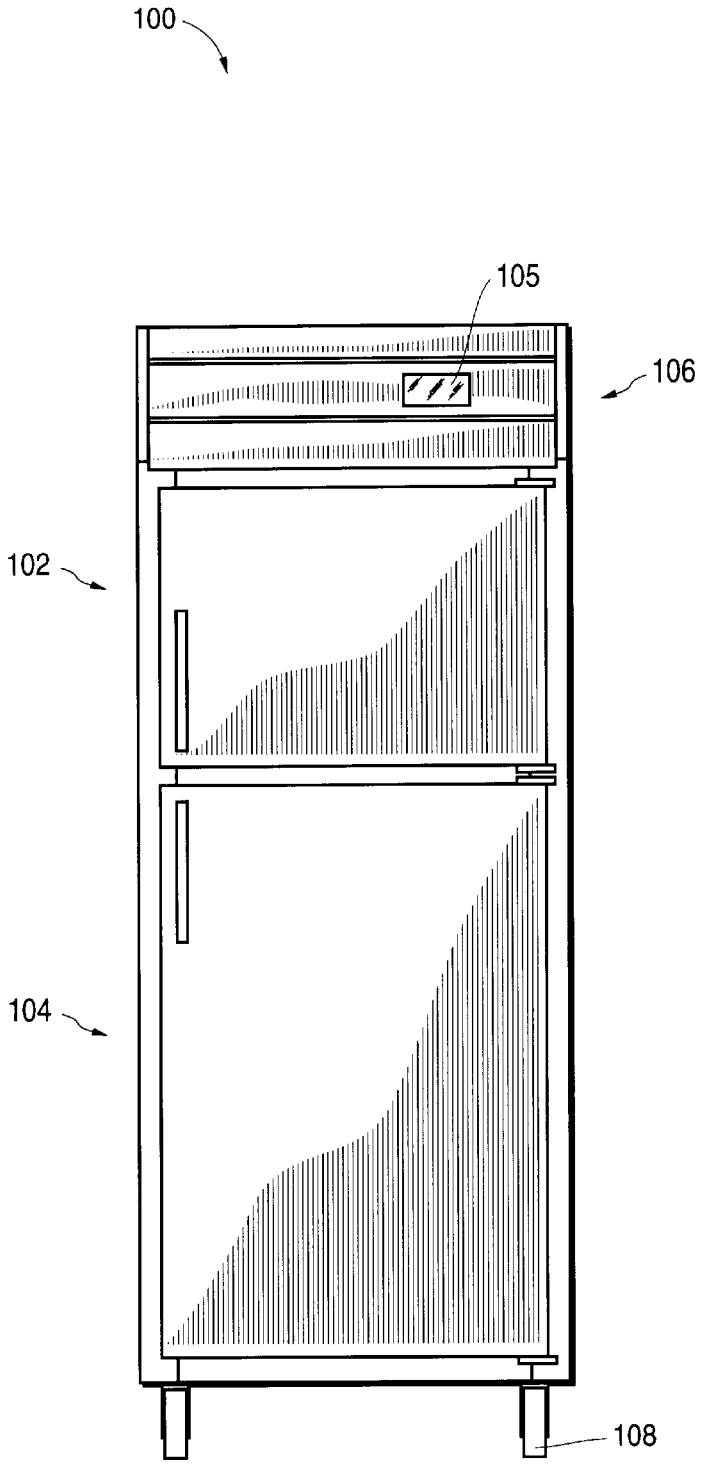
FIG. 1 illustrates a front view of a two-chamber refrigerator, according to one embodiment of the present invention.

FIG. 1 illustrates a front view of the outside of a two-chamber refrigerator, according to one embodiment of the present invention. Refrigerator unit 100 includes a first compartment 102 and a second compartment 104. A control compartment 106 for housing a control unit is mounted in the top part of refrigerator 100 above the first compartment 102. In one embodiment, the control compartment is covered with a hinged panel or cover that allows access to the control unit. The control panel includes a transparent window 105 that allows a user to view the temperature or operating settings of the refrigerator. The dimensions, material, weight, and other physical characteristics of the refrigerator unit 100 can be configured to specific requirements, depending upon the environment and requirements of the application in which the refrigerator is used.

Figure 2:
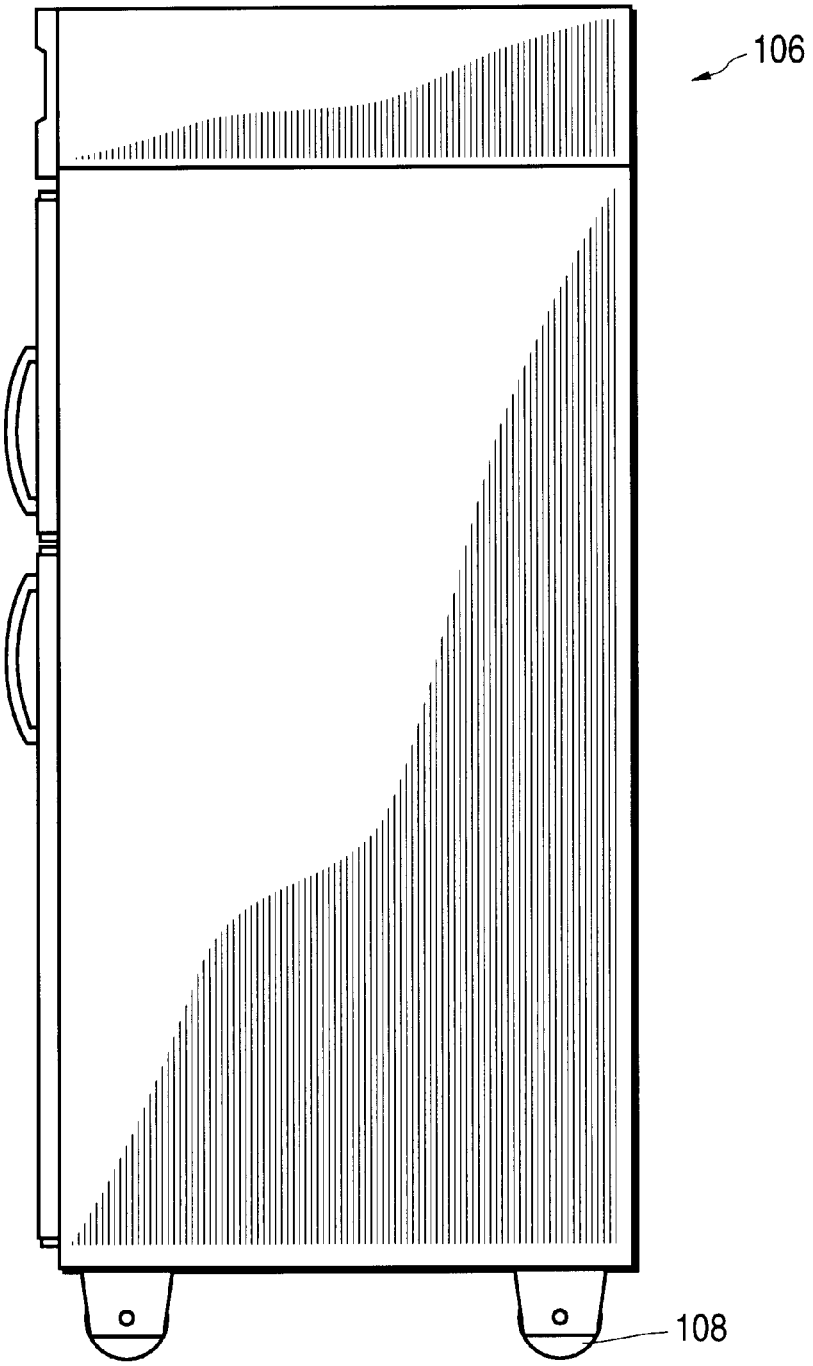
FIG. 2 illustrates a side view of the outside of refrigerator unit shown in FIG. 1.

FIG. 2 illustrates a side view of the outside of refrigerator unit 100 of FIG. 1. In one embodiment, the refrigerator unit 100 has outside dimensions of 29.1 inches wide, 71.2 inches high, and 32.5 inches deep, and inside dimensions of 24.0 inches wide, 57.0 inches high, and 26.7 inches deep. These dimensions give a capacity of 21 cubic feet, and the interior can be configured for use with a number of shelves and drawers for storage of food items. The interior and exterior surfaces are made of stainless steel, and four castor wheels 108 may be provided to facilitate movement of the refrigerator. In one embodiment a refrigerator pump rated at ⅕ horsepower is used. The refrigerant used in R134A.

The control unit within the control compartment 106 contains electrical circuitry that controls the temperature and operating characteristics of the two compartments 102 and 104. The temperature range of the refrigerator units covers 21 degrees Fahrenheit to 42 degrees Fahrenheit. In one embodiment, the operating characteristic of both compartments 102 and 104 can be programmed to operate independently of one another across a wide range of operating temperatures. For example, the first compartment 102 can be programmed to operate at standard refrigerator temperatures around 40 degrees Fahrenheit, while the second compartment 104 can be programmed to operate at freezer temperatures around 25 degrees Fahrenheit. Alternatively, the first compartment can be configured to operate as a freezer, while the second compartment is configured to operate as a refrigerator. In a further alternative embodiment, both compartments can be programmed to operate as freezer chambers or refrigerator chambers. The digital control provided by the control unit allows the user to easily control the operating characteristics of the compartments of refrigerator 100.

Figure 3:
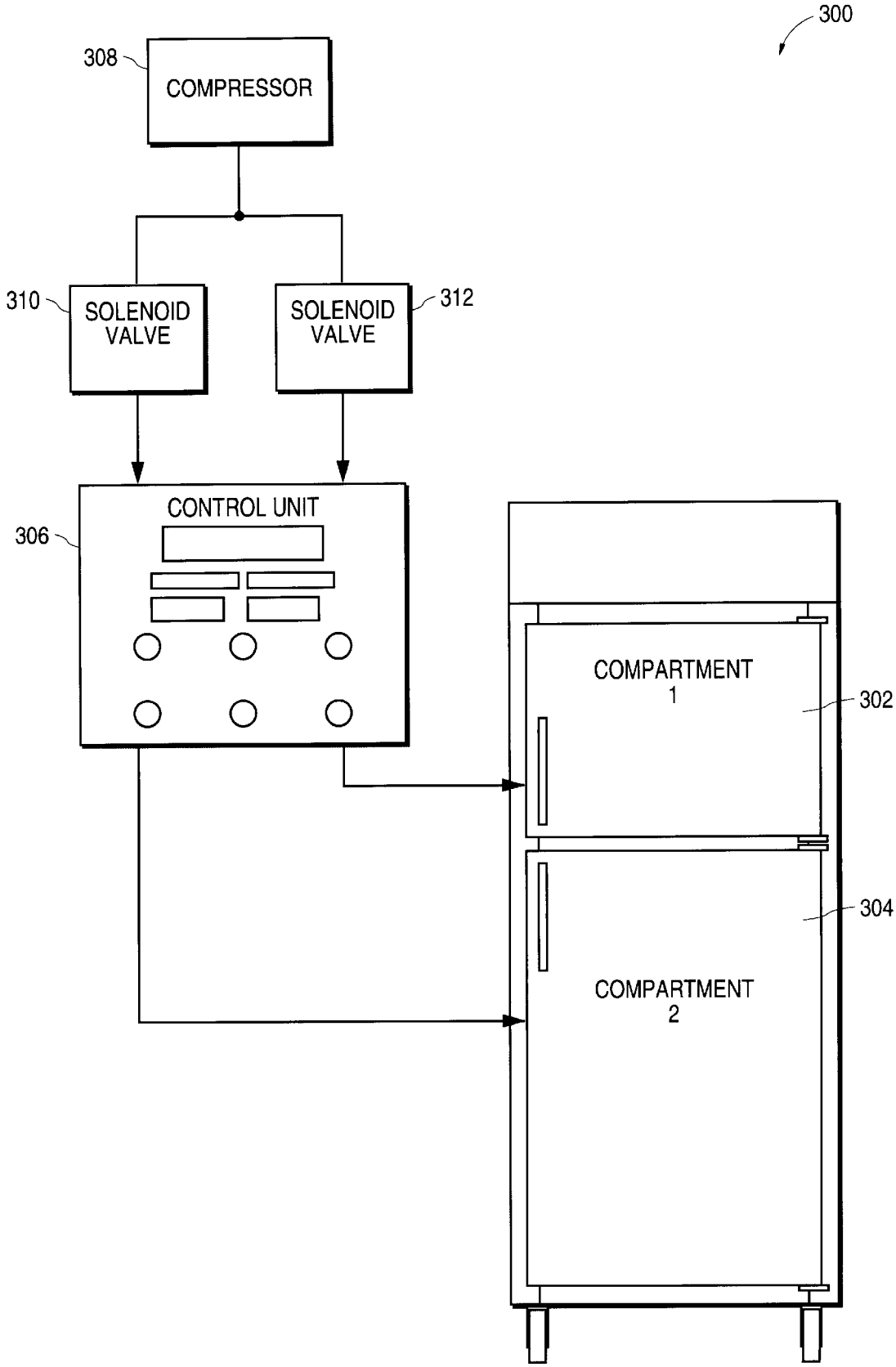
FIG. 3 is a functional block diagram of the refrigerator unit illustrated in FIG. 1, according to one embodiment of the present invention.

FIG. 3 is a block diagram of the refrigerator unit 100 illustrated in FIG. 1, according to one embodiment of the present invention. Refrigerator unit 300 comprises a first compartment 302 and a second compartment 304 both coupled to a control unit 306. The control unit 306 provides electrical signals that control the operating temperature ranges of compartments 302 and 304. A single compressor 308 is coupled to the control unit 306. A first solenoid valve 310 is used to control the compressor output to the control panel for control of the first compartment 302, and a second solenoid valve 312 is used to control the compressor output to the control panel for control of the second compartment 304. The use of a single compressor to drive both compartments of the dual compartment unit reduces the hardware necessary to manufacture the refrigerator. It also allows reduced operating costs since less electricity is required to run a single compressor. In one embodiment, a back-up compressor may be provided. For this embodiment, the back-up compressor is coupled in parallel with the first compressor to both compartments, and operation of the back-up compressor is only initiated upon failure of the first compressor.

The compressor 308 serves to pump the refrigerant through the coils of the refrigerator compartments In one embodiment of the present invention, the refrigerator unit 300 employs fin coil evaporators to provide indirect and even circulation of cold air through the compartments 302 and 304. This embodiment may also employ an air duct system that vacuums cool air closer to the ground and blows it over the condenser. This reduces compressor run-time and increases efficiency. The fin coil evaporators are placed on the underside of the top surface of the compartments and configured to circulate air downward and forwards through the use of directional nozzles. The air duct system is generally mounted to the back side of the compartments and provide cool air to the fin coil evaporators.

The solenoid valves 310 and 312 are configured to open at a preset operating temperature. In one embodiment, the solenoid valves are configured at the factory and the settings are not alterable by the user. In an alternative embodiment, the solenoid valve settings are configurable by the user through the control unit 306.

Figure 4:
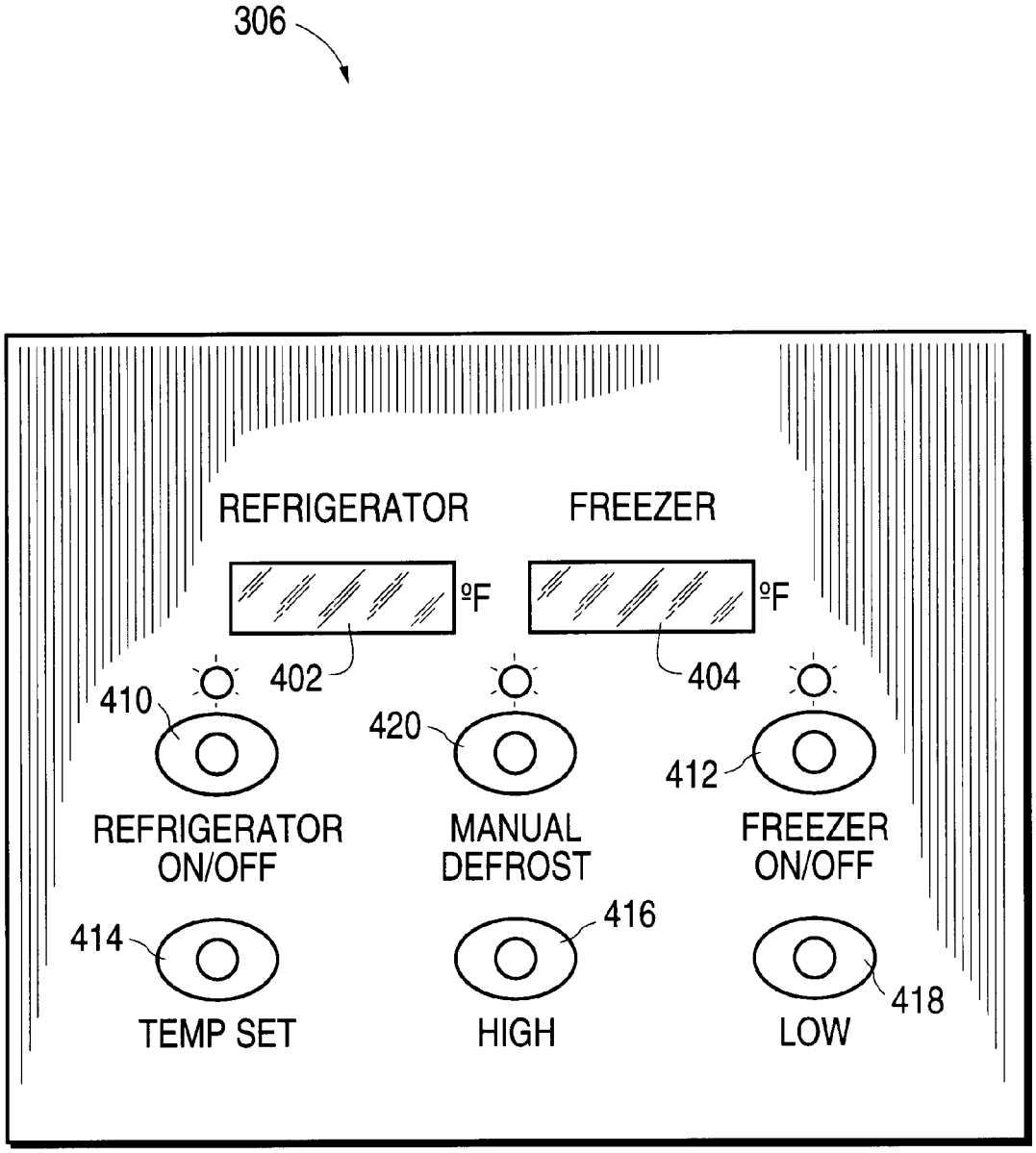
FIG. 4 illustrates a front view of a control unit for a dual compartment refrigerator, according to one embodiment of the present invention.

FIG. 4 illustrates the control unit 306 in greater detail, according to one embodiment of the present invention. Control unit 306 includes a series of pushbutton switches for user input of operating parameters for refrigerator unit 100 as well as digital readouts for displaying the operating temperatures of the two compartments. For the embodiment illustrated in FIG. 4, the compartment marked "refrigerator" may refer to compartment 1, while the compartment marked "freezer" may refer to compartment 2. Alternatively, the compartment labels can be switched, depending upon how the compartments are configured for use.

Figure 5:
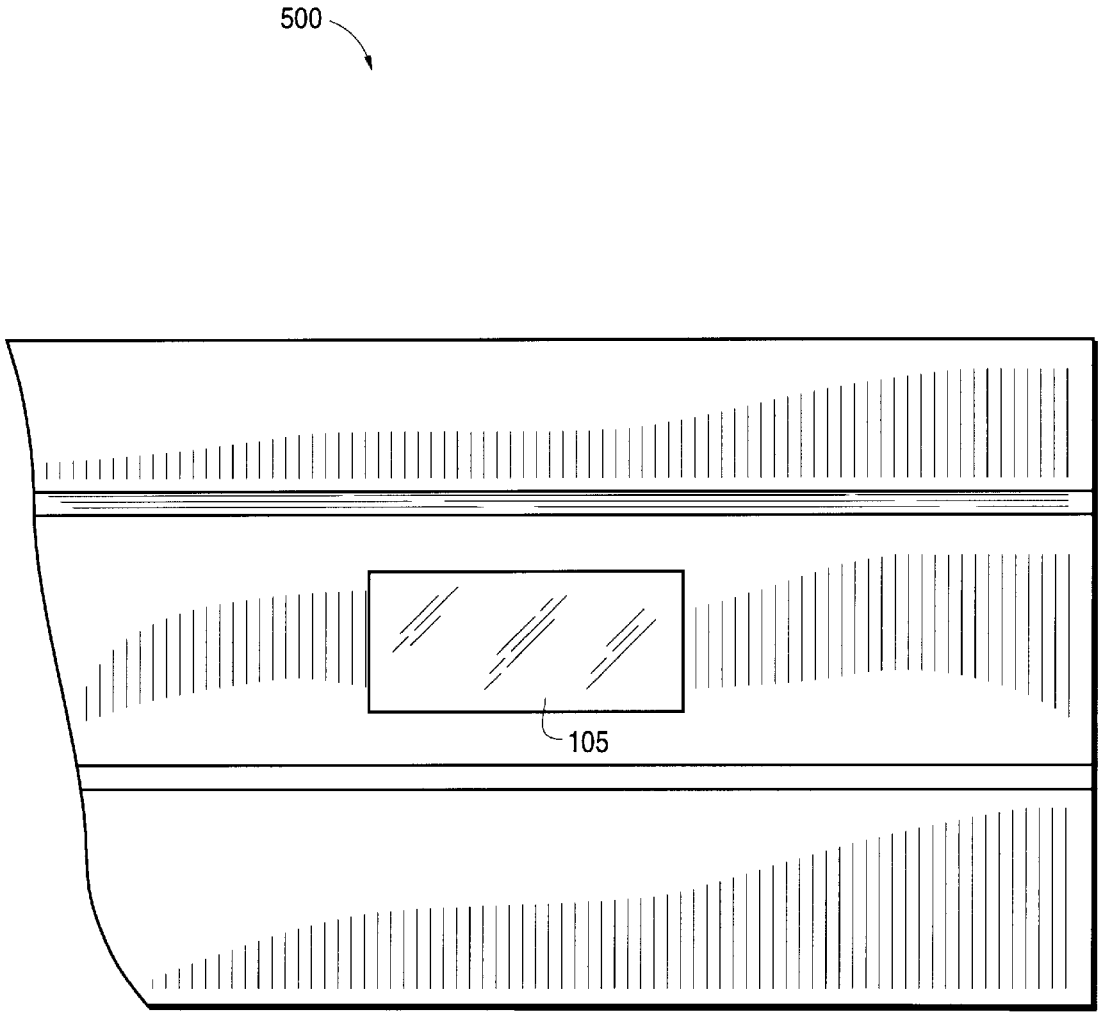
FIG. 5 illustrates a control panel that covers the control unit of FIG. 4, according to on embodiment of the present invention.

The control unit 306 includes a first digital display area 402 that displays the temperature setting for the refrigerator compartment, and a second digital display area 404 that displays the temperature setting for the freezer compartment. These displays are visible through the top panel 106 through a transparent window 105 of glass or plastic that is incorporated into the top panel, as illustrated in FIG. 5 The control unit 306 includes several pushbutton controls that allows the user to input operating characteristics for the refrigerator. A first on/off switch 410 is provided for the refrigerator compartment, and second on/off switch 412 is provided for the freezer compartment. A temperature setting button 414 is provided for either of the two compartments. When the user desires to set the temperature of either of the compartments, he or she presses this button. The temperature that the compartment is to run is then programmed in using the high 416 or low 418 buttons. Pressing the high button 416 raises the pre-set operating temperature, and pressing the low button 418 lowers the pre-set operating temperature. The actual operating temperature of the compartments is displayed in display areas 402 and 404.

The actual programming steps to set or reset the operating temperatures for the compartments can be configured depending upon the actual users needs and implementation. However, in one embodiment, the following steps are performed. When a particular compartment is turned on, the red light above the on/off switch for that compartment is illuminated. In order to set the temperature in a particular compartment, the temperature set pushbutton switch 414 is pressed. The indicator light for the compartment will blink to indicate that the desired temperature can be entered. This is done by using the high and low buttons 416 and 418. During normal operation, it may take one to two hours for the temperature to drop to the desired setting.

In one embodiment of the present invention, the refrigeration system 100 includes a manual defrost feature activated by pushbutton 420 on control panel 306. Unlike typical present refrigeration systems that perform defrost operations periodically based upon a factory set time, embodiments of the present invention allow a user to manually activate a defrost cycle. The defrost circuitry comprises a timer and a thermocouple connected to the evaporator coils of the refrigeration compartments.

In automatic defrost mode, the temperature cycles over a 15 to 20 minute period. For example, for a 13 hour defrost period, the temperature may fluctuate every six hours or so. A thermometer placed near the evaporator coil reads the temperature of the coil. As ice builds up on the coil, the temperature drops. When the temperature drops below a predetermined threshold, the automatic defrost circuit is activated to heat the evaporator coil and melt the built-up ice. In general, the actual temperature inside of the refrigerator compartment will not fluctuate more than five degrees Fahrenheit.

The use of a manual defrost circuit allows the automatic defrost feature to be overridden by the user. In general, it is not possible for a user to alter the defrost cycle time in an automatic defrost refrigerator. However, to reduce temperature fluctuations due to auto defrost circuits, or to allow the user to defrost the evaporator coils more or less frequently, the manual defrost feature is incorporated into embodiments of the present invention. In another embodiment of the present invention, the defrost cycle time for the automatic defrost feature can be programmed by the user using control unit 306. This allows the user to set the defrost period directly. For this embodiment, the manual defrost circuit can be used to override a user programmed automatic defrost period, as well.

In one embodiment, the control unit is mounted to the top of the uppermost compartment 102 in a dedicated control compartment 106. The control unit is hidden behind a control panel that is designed and manufactured in a finish that matches the rest of the refrigerator. FIG. 5 illustrates a control panel 500 that covers the control unit, according to on embodiment of the present invention. The control panel 500 includes a display window 105 that allows the display of the digital temperature read outs 402 and 404 on unit 306.

Figure 6A:
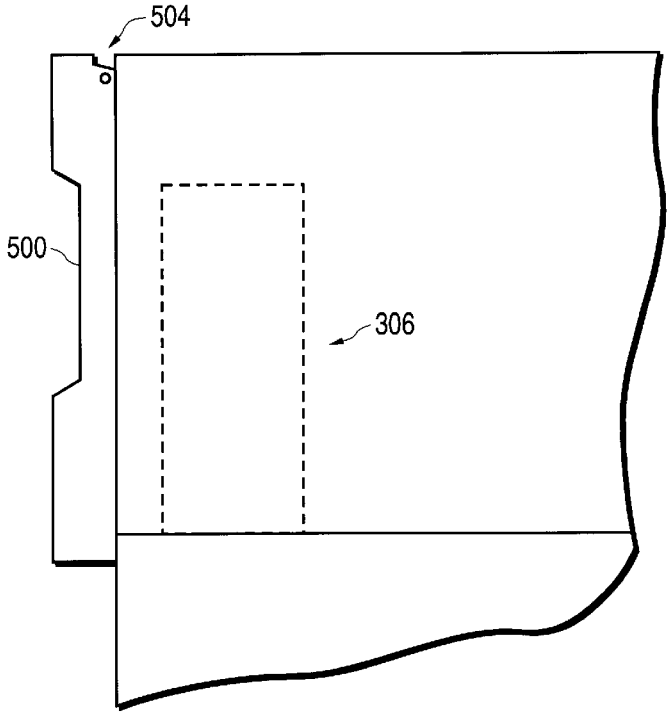
FIG. 6A is a side view of the control unit of FIG. 4 within a control compartment of a refrigeration system, according to one embodiment of the present invention.
Figure 6B:
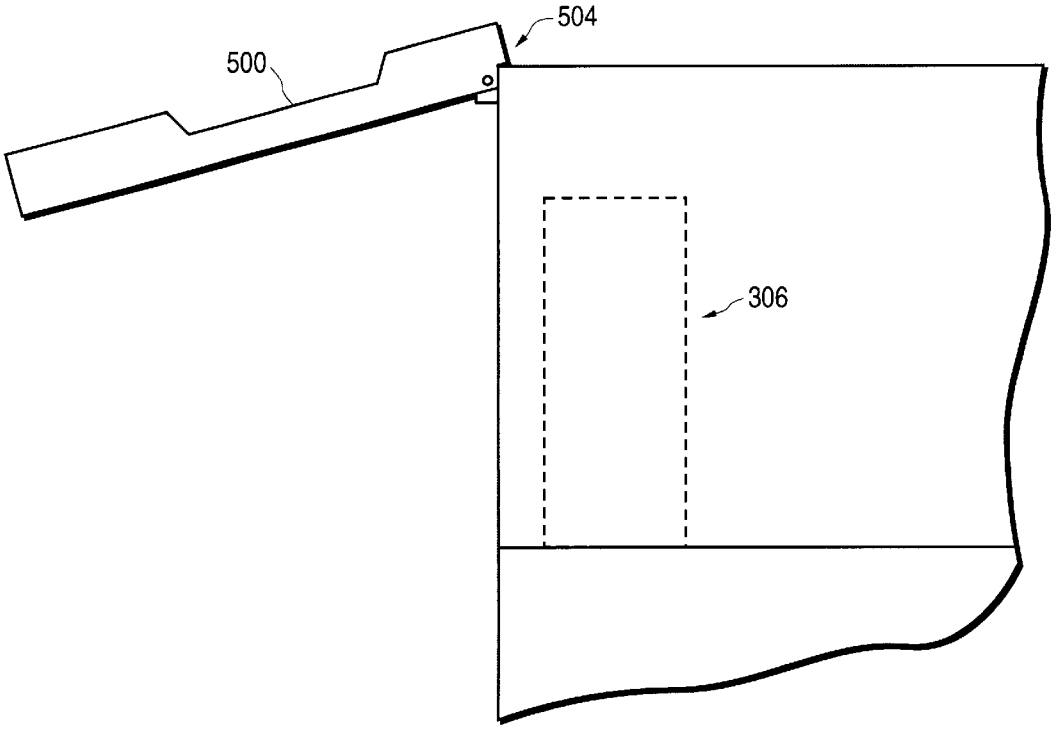
FIG. 6B is a side view of the control compartment illustrated in FIG. 6A with the hinged control panel in an open position.

In one embodiment of the present invention, the control panel 500 is a hinged panel that covers the control unit. The hinged panel opens upward to allow access to the control unit. FIG. 6A is a side view of the control panel 500 of FIG. 5 and shows the hinge point 504. FIG. 6B is a side view of the control panel 500 that shows the control panel in an open position. This allows the user to access the controls on the control unit 306. The use of a hidden control unit and displays that are visible from the exterior of the refrigerator unit allows the user to conveniently set and view the operating characteristics of the refrigeration unit without needing to open the compartments of the refrigerator. This allows the refrigerator to run more efficiently and enhances the usability of the refrigerator.

It should be noted that the control panel 500 can be hinged at various points along the interface with the body of the refrigeration unit. For these embodiments, the control panel can be configured to swing downwards, or to the side in order to open the upper portion of the refrigeration unit to expose the control panel.

Figure 8:
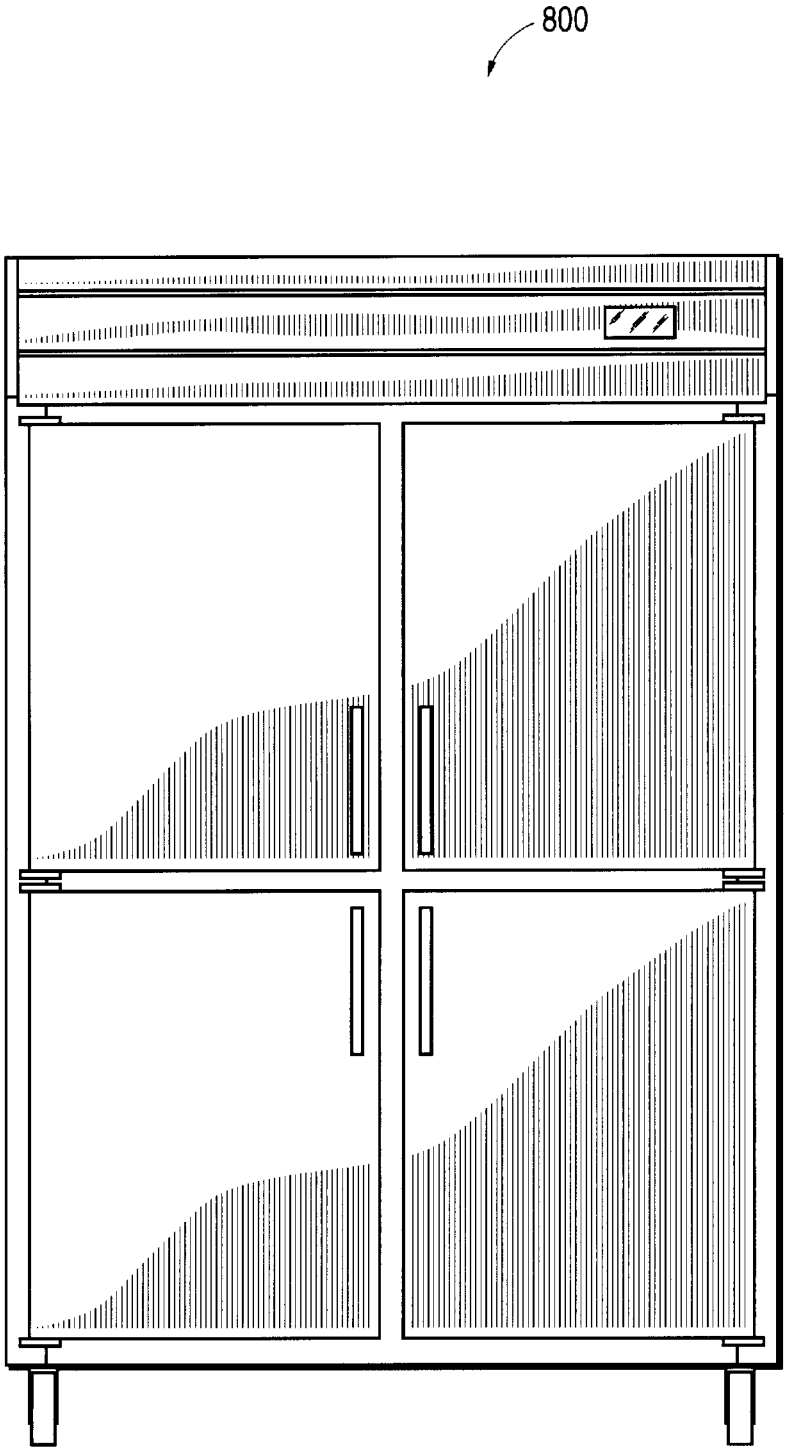
FIG. 8 is a multi-compartment refrigeration unit, according to an alternative embodiment of the present invention.

Although the embodiment illustrated in FIG. 1 illustrates a dual-chamber refrigerator comprising a refrigerator compartment and a freezer compartment, the refrigerator unit of the present invention can be configured as a four-compartment unit as well. FIG. 8 illustrates a four-compartment refrigerator unit, according to an alternative embodiment of the present invention. For the embodiment illustrated in FIG. 8, a single compressor runs the refrigerant to the compartments, and each compartment is coupled to the compressor through a dedicated solenoid valve.

Figure 7:
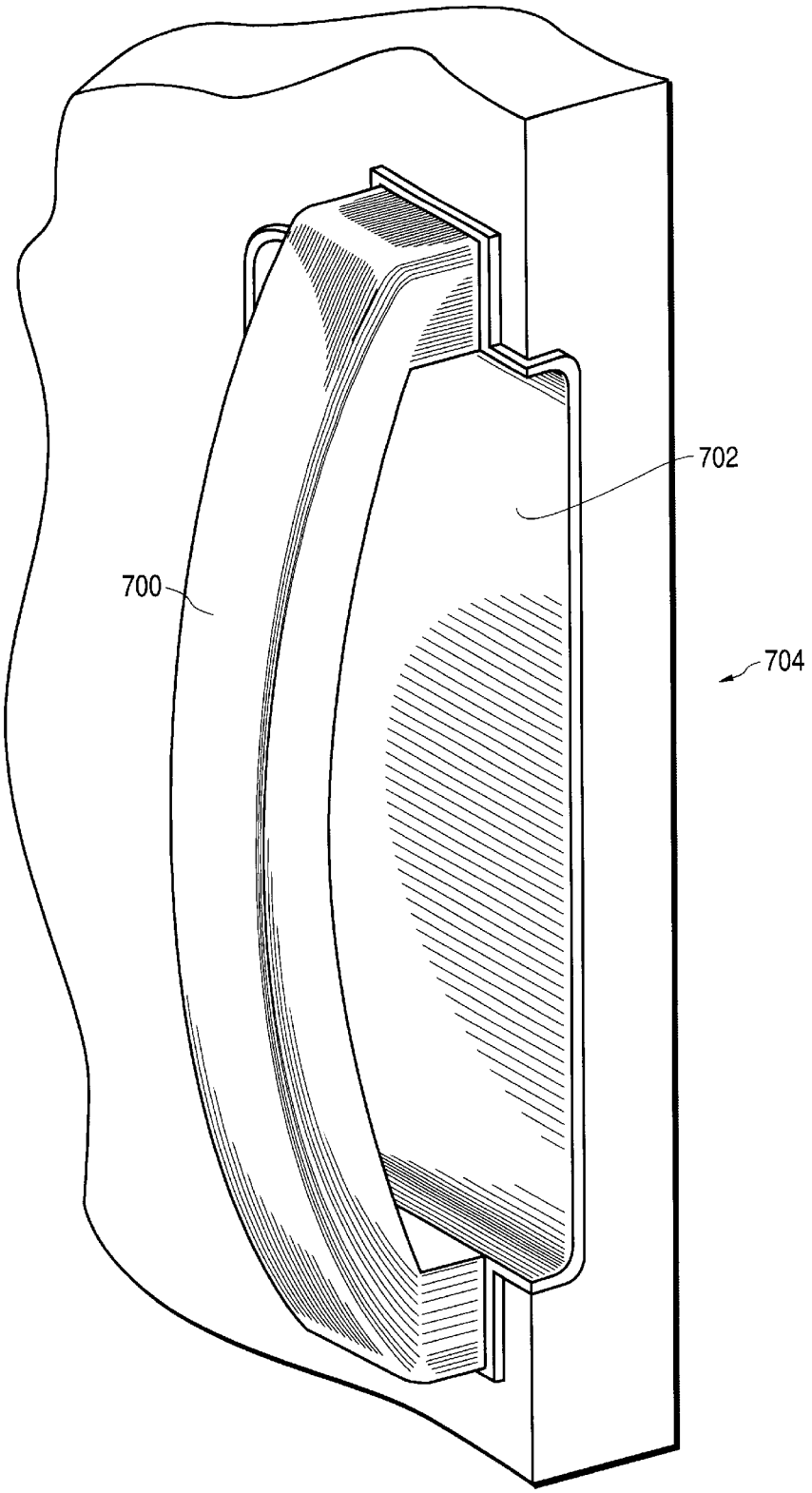
FIG. 7 illustrates a door handle of the multi-compartment refrigerator unit, according to one embodiment of the present invention.

Each compartment of the multi-compartment refrigerator unit is enclosed by a hinged door. Each door has a pull handle of smooth stainless steel. FIG. 7 illustrates the door handle 700 of the multi-compartment refrigerator unit, according to one embodiment of the present invention. To accommodate the grasping of the handle, an indentation is formed into the door. It should be noted that various different styles, shapes, sizes and configurations of door handles can be used with in conjunction with a refrigerator in accordance with embodiments of the present invention.

As will be appreciated by those of ordinary skill in the art, refrigerator units with various different configurations and number and sizes of compartments can be manufactured in accordance with the embodiments described herein.

In the foregoing, a multi-chamber refrigerator unit has been described. Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A refrigeration unit comprising:

a first refrigeration compartment within a housing;

a second refrigeration compartment within the housing and mechanically coupled to the first refrigeration compartment;

a control unit electrically coupled to the first refrigeration unit and the second refrigeration compartment;

a compressor coupled to the control unit through a first solenoid valve and through a second solenoid valve, the first solenoid valve operable to alter an operating temperature of the first refrigeration compartment, and the second solenoid valve operable to alter an operating temperature of the second refrigeration compartment; and a manual defrost circuit coupled to the control unit and operable to activate a defrost cycle of the refrigeration unit upon manual input of a defrost command by a user.

2. The refrigeration unit of claim 1 wherein the first refrigeration compartment is configured to operate at a first range of temperatures, and the second refrigeration compartment is configured to operate at a second range of temperatures.

3. The refrigeration unit of claim 2 further comprising a fin coil evaporator system coupled to the first refrigeration compartment and the second refrigeration compartment.

4. The refrigeration unit of claim 3 further comprising an air duct system coupled to the first refrigeration compartment and the second refrigeration compartment.

5. The refrigeration unit of claim 3 wherein the manual defrost circuit comprises an override switch coupled to the fin coil evaporator system, and configured to bypass an automatic defrost circuit coupled to the first refrigeration compartment and the second refrigeration compartment.

6. The refrigeration unit of claim 2 wherein the control unit comprises:

a first display area operable to display an operating temperature of the first refrigeration compartment; and a second display area operable to display an operating temperature of the second refrigeration compartment.

7. The refrigeration unit of claim 6 wherein the control unit further comprises a plurality of pushbutton switches operable to allow the user to enter a plurality of operating parameters for operation of the refrigeration unit.

8. The refrigeration unit of claim 7 wherein the control unit further comprises:

a first pushbutton control that allows the user to set an operating temperature of the first refrigeration compartment;

a second pushbutton control that allows the user to set an operating temperature of the second refrigeration compartment; and a third pushbutton control that allows the user to initiate a manual defrost cycle of the refrigeration unit.

9. The refrigeration unit of claim 8 further comprising a control panel coupled to the housing and configured to cover the control unit when placed in a deployed position, the control panel comprising a display window configured to allow user viewing of the first display area and second display area when the control panel is in the deployed position.

10. The refrigeration unit of claim 9 wherein the control panel is coupled to the housing through a hinge, and wherein the control unit is accessible to the user when the control panel is in a raised position.

11. The refrigeration unit of claim 10 wherein first refrigeration compartment and the second refrigeration compartment are disposed vertically in relation to one another, and wherein the control unit is contained in a control panel compartment disposed above the uppermost of the first and second refrigeration compartments.

12. A control unit for controlling operating conditions of a dual-compartment refrigerator comprising a compressor coupled to a first refrigeration compartment and a second refrigeration compartment, the control unit comprising:

a first display area operable to display an operating temperature of the first refrigeration compartment;

a second display area operable to display an operating temperature of the second refrigeration compartment;

a plurality of pushbutton switches operable to allow a user to enter a plurality of operating parameters for operation of the refrigerator; and a manual defrost circuit operable to activate a defrost cycle of the refrigerator upon manual input of a defrost command by a user.

13. The control unit of claim 12 further comprising:

a first pushbutton control that allows the user to set an operating temperature of the first refrigeration compartment;

a second pushbutton control that allows the user to set an operating temperature of the second refrigeration compartment; and a third pushbutton control that allows the user to initiate a manual defrost cycle of the refrigeration unit.

14. The control unit of claim 13 wherein the control unit is coupled to a first solenoid valve and a second solenoid valve, the first solenoid valve operable to alter an operating temperature of the first refrigeration compartment in accordance with operating parameters input by the user through the first pushbutton control, and the second solenoid valve operable to alter an operating temperature of the second refrigeration compartment in accordance with operating parameters input by the user through the second pushbutton control.

15. The control unit of claim 14 wherein the manual defrost circuit comprises an override switch coupled to a fin coil evaporator system coupled to the compressor, and configured to bypass an automatic defrost circuit coupled to the first refrigeration compartment and the second refrigeration compartment.

16. The control unit of claim 15 wherein first refrigeration compartment and the second refrigeration compartment are disposed vertically in relation to one another, and wherein the control unit is contained in a control compartment disposed above the uppermost of the first and second refrigeration compartments, the control compartment comprising:

a control panel coupled to a housing containing the first and second refrigeration compartments and configured to cover the control unit when placed in a deployed position, the control panel comprising a display window configured to allow user viewing of the first display area and second display area when the control panel is in the deployed position.

17. The control unit of claim 16 wherein the control compartment is coupled to the housing through a hinge, and wherein the control unit is accessible to the user when the control panel is in a raised position.

* * * * *